US009752836B2

(12) United States Patent
Ito et al.

(10) Patent No.: US 9,752,836 B2
(45) Date of Patent: Sep. 5, 2017

(54) PLATE HEAT EXCHANGER AND HEAT PUMP APPARATUS

(75) Inventors: Daisuke Ito, Tokyo (JP); Takehiro Hayashi, Tokyo (JP); Shinichi Uchino, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 1184 days.

(21) Appl. No.: 13/878,601

(22) PCT Filed: Nov. 12, 2010

(86) PCT No.: PCT/JP2010/070179

§ 371 (c)(1),
(2), (4) Date: Apr. 10, 2013

(87) PCT Pub. No.: WO2012/063355

PCT Pub. Date: May 18, 2012

(65) Prior Publication Data

US 2013/0192291 A1 Aug. 1, 2013

(51) Int. Cl.
*F25B 29/00* (2006.01)
*F28F 3/08* (2006.01)
(Continued)

(52) U.S. Cl.
CPC ..... *F28F 3/08* (2013.01); *F25B 13/00* (2013.01); *F25B 30/02* (2013.01); *F25B 39/04* (2013.01);
(Continued)

(58) Field of Classification Search
CPC ... F28F 3/08; F28F 9/0268; F28F 3/12; F25B 13/00; F25B 30/02; F25B 39/00;
(Continued)

(56) References Cited

U.S. PATENT DOCUMENTS 4,523,638 A * 6/1985 Rosman ..... F28D 9/0018 165/167
4,911,235 A * 3/1990 Andersson ..... F28F 3/083 165/166
(Continued)

FOREIGN PATENT DOCUMENTS

JP 58-096987 A 6/1983
JP 61-500626 A 4/1986
(Continued)

OTHER PUBLICATIONS

Office Action mailed Aug. 1, 2014 issued in corresponding CN patent application No. 201080070070.4.
(Continued)

*Primary Examiner* — Travis Ruby
(74) *Attorney, Agent, or Firm* — Posz Law Group, PLC

(57) ABSTRACT

A plate heat exchanger includes a plurality of rectangular plates each having, at four corners thereof, inlets and outlets and others for a first fluid and a second fluid. The plates are stacked such that first passages each defined by adjacent two of the plates and through which the first fluid flows and second passages each defined by adjacent two of the plates and through which the second fluid flows are provided alternately. The first passage includes a bypass passage extending from an inlet peripheral portion, which is an area around the inlet, along the outlet for the second fluid up to a long-side-peripheral portion of the plate that is nearer to the second outlet. The bypass passage allows some of the first fluid having flowed therein from the inlet to flow from the long-side-peripheral portion into a heat-exchanging passage.

15 Claims, 16 Drawing Sheets

(51) Int. Cl.

| | |
|---|---|
| ***F28D 9/00*** | (2006.01) |
| ***F28F 9/02*** | (2006.01) |
| ***F25B 13/00*** | (2006.01) |
| ***F25B 30/02*** | (2006.01) |
| ***F25B 39/04*** | (2006.01) |
| *F25B 39/00* | (2006.01) |

(52) U.S. Cl.
CPC ..... *F28D 9/005* (2013.01); *F28F 9/0268* (2013.01); *F25B 39/00* (2013.01); *F25B 2313/003* (2013.01); *F25B 2313/02741* (2013.01); *F25B 2341/0662* (2013.01); *F25B 2400/053* (2013.01); *F25B 2400/13* (2013.01); *F25B 2400/16* (2013.01)

(58) Field of Classification Search
CPC ..... F25B 39/04; F25B 2313/003; F25B 2313/02741; F25B 2400/053; F25B 2400/13; F25B 2400/16; F28D 9/005
See application file for complete search history.

(56) References Cited

U.S. PATENT DOCUMENTS 6,394,178 B1 * 5/2002 Yoshida ..... F28D 9/005 165/166
2003/0094271 A1 * 5/2003 Leuthner ..... F28D 9/005 165/167
2009/0211282 A1 * 8/2009 Nishimura ..... F24D 17/02 62/238.6

FOREIGN PATENT DOCUMENTS

| | | | |
|---|---|---|---|
| JP | 06-281377 | A | 10/1994 |
| JP | 08-271172 | A | 10/1996 |
| JP | 11-037676 | A | 2/1999 |
| JP | 11-037677 | A | 2/1999 |
| JP | 2001-280889 | A | 10/2001 |
| JP | 2007-514124 | A | 5/2007 |
| JP | 2007-205634 | A | 8/2007 |
| JP | 2008-170090 | A | 7/2008 |
| WO | 2005057118 | A1 | 6/2005 |
| WO | 2009151399 | A1 | 12/2009 |

OTHER PUBLICATIONS

Office Action mailed Mar. 18, 2014 issued in corresponding JP patent application No. 2012-542773 (and English translation).
International Search Report of the International Searching Authority mailed Feb. 15, 2011 for the corresponding international application No. PCT/JP2010/070179 (with English translation).

* cited by examiner

PRIOR ART

PRIOR ART

PRIOR ART

PRIOR ART

PRIOR ART

PRIOR ART

PRIOR ART

PRIOR ART

PLATE HEAT EXCHANGER AND HEAT PUMP APPARATUS

CROSS REFERENCE TO RELATED APPLICATIONS

This application is a U.S. national stage application of PCT/JP2010/070179 filed on Nov. 12, 2010.

TECHNICAL FIELD

The present invention relates to a plate heat exchanger including a plurality of heat transfer plates that are stacked.

BACKGROUND ART

In a known plate heat exchanger, portions of a passage formed between adjacent ones of heat transfer plates are sealed near an inlet and an outlet for a fluid (see Patent Literature 1).

In another plate heat exchanger, the positions of an inlet and an outlet for a fluid are changed and sealed portions are provided so as to avoid the stagnation of the fluid in the plate heat exchanger and the freezing of the fluid in the plate heat exchanger (see Patent Literature 2).

In yet another plate heat exchanger, waves extend from a position near each of an inlet and an outlet in such a manner as to be substantially parallel to one another and at regular intervals, or waves extend radially with respect to the short-side center line of the plate (see Patent Literature 3).

CITATION LIST

Patent Literature

Patent Literature 1: Japanese Unexamined Patent Application Publication (Translation of PCT Application) No. 61-500626

Patent Literature 2: Japanese Unexamined Patent Application Publication No. 11-037677

Patent Literature 3: Japanese Unexamined Patent Application Publication No. 58-96987

SUMMARY OF INVENTION

Technical Problem

It is difficult for a fluid that flows in a known plate heat exchanger to flow into areas that are on the opposite side of the inlet and the outlet, respectively, in the short-side direction and tends to stagnate in those areas. A case where the plate heat exchanger is used as an evaporator that causes water and a refrigerant to exchange heat therebetween will be taken as an example. If the above stagnation occurs in a passage on the water side, the temperature of water in that area rapidly drops compared with the peripheral temperature. Consequently, water is frozen in that area, damaging the heat exchanger.

To avoid this, in Patent Literature 2, the positions of the inlet and the outlet are changed, and the sealed portions are provided in the areas near the inlet and the outlet, respectively, where water stagnates, whereby the occurrence of stagnation is prevented. Nevertheless, since water does not flow in the sealed portions, the area of heat transfer is reduced, deteriorating the heat-exchanging performance. In Patent Literature 3, waves extend from a position near each of an inlet and an outlet in such a manner as to be substantially parallel to one another and at regular intervals, or waves extend radially with respect to the short-side center line of the plate. Nevertheless, in the case where waves extend substantially parallel to one another and at regular intervals, since the waves are arranged at regular intervals, the speed of flow of the water is reduced and flows toward the downstream side before the water reaches an outer edge that is on the side opposite the water inlet or outlet in the short-side direction. Therefore, water does not flow through the above area. In the case where waves extend radially, no passages are provided for forcing the fluid to flow toward the outer edge that is on the opposite side of the water inlet or outlet in the short-side direction. Therefore, the fluid does not flow through the above area.

It is an object of the present invention to prevent the occurrence of stagnation of a fluid in a plate heat exchanger without reducing the area of heat transfer.

Solution to Problem

A plate heat exchanger according to the present invention is a plate heat exchanger including a plurality of rectangular plates each having, at four corners thereof, respective passage holes each serving as an inlet or an outlet for a first fluid or a second fluid, the plates being stacked such that first passages each defined by adjacent two of the plates and through which the first fluid flows and second passages each defined by adjacent two of the plates and through which the second fluid flows are formed alternately in a stacking direction, wherein the first passage allows the first fluid having flowed therein from an inlet as one of the passage holes that is provided on one side of each of the plates in a long-side direction to be discharged from an outlet as one of the passage holes that is provided on the other side of the plate in the long-side direction, the first passage including a heat-exchanging passage formed between the inlet and the outlet and in which the first fluid and the second fluid that flows through the second passage adjacent to the first passage exchange heat therebetween, and wherein the first passage includes an upstream-side bypass passage extending from an inlet peripheral portion, which is an area around the inlet, along an upstream-side adjacent hole, which is another one of the passage holes that is provided on the one side in the long-side direction and is different from the inlet, up to a long-side-peripheral portion, which is an area around a long side of the plate that is nearer to the upstream-side adjacent hole, the upstream-side bypass passage being connected to the heat-exchanging passage and allowing some of the first fluid having flowed therein from the inlet to flow from the long-side-peripheral portion into the heat-exchanging passage, the upstream-side bypass passage having a cross-sectional passage area that is reduced toward the long-side-peripheral portion.

Advantageous Effects of Invention

In the plate heat exchanger according to the present invention, the first fluid flows from the bypass passage to a side of the heat-exchanging path that is opposite the inlet in the short-side direction. Hence, the occurrence of stagnation of the first fluid is prevented.

DESCRIPTION OF EMBODIMENTS

Embodiment 1

A basic configuration of a plate heat exchanger 50 according to Embodiment 1 will now be described.

Figure 1:
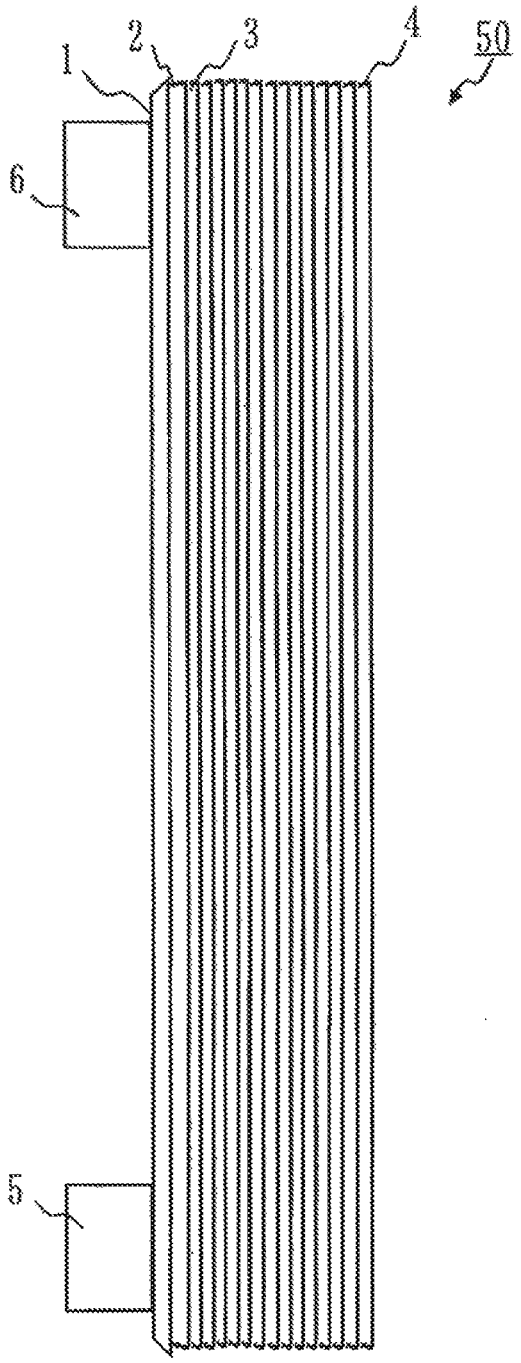
FIG. 1 is a side view of a plate heat exchanger 50.
Figure 2:
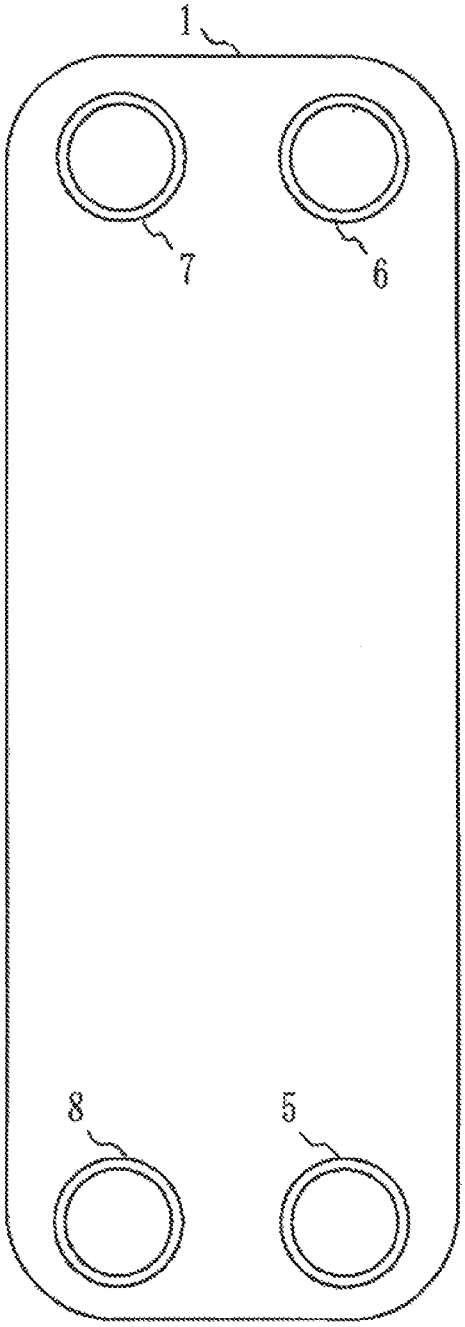
FIG. 2 is a front view of a reinforcing side plate 1.
Figure 3:
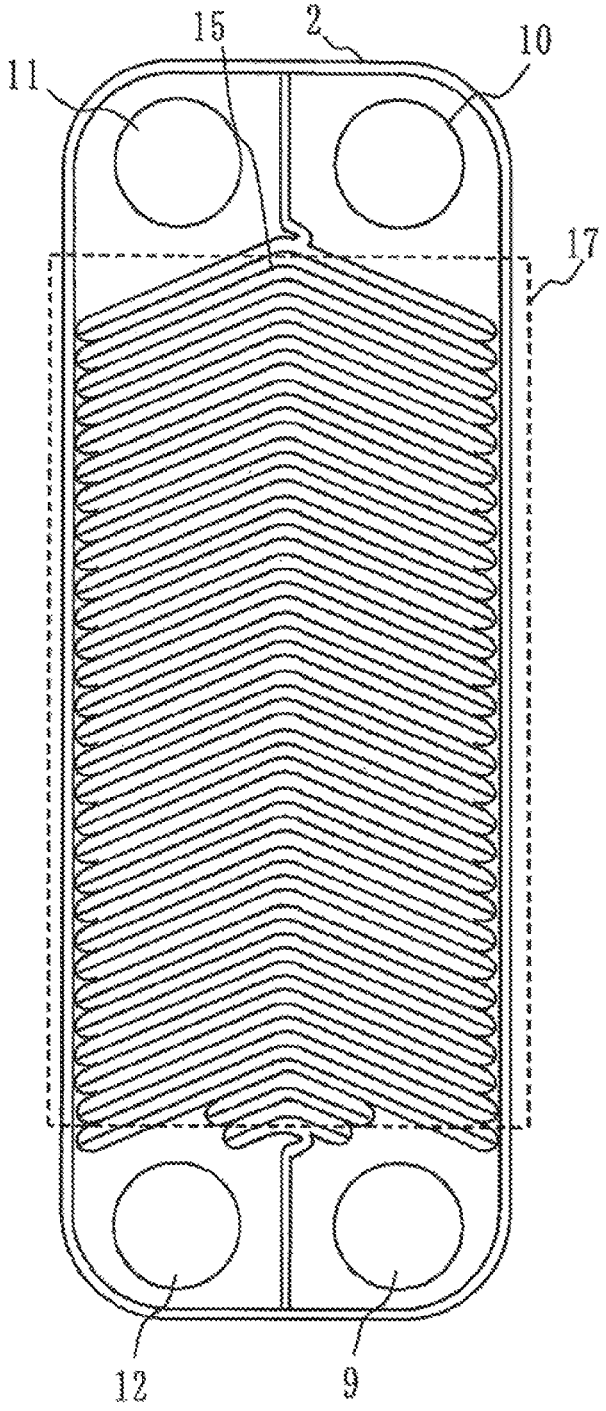
FIG. 3 is a front view of a heat transfer plate 2.
Figure 4:
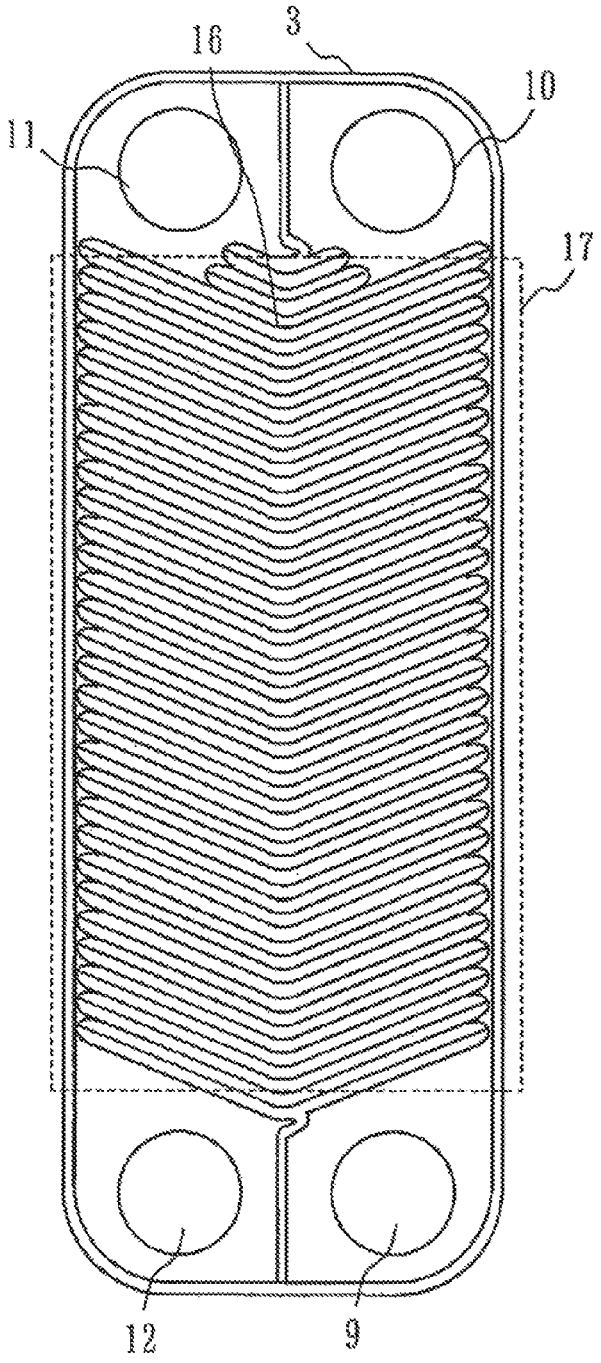
FIG. 4 is a front view of a heat transfer plate 3.
Figure 5:
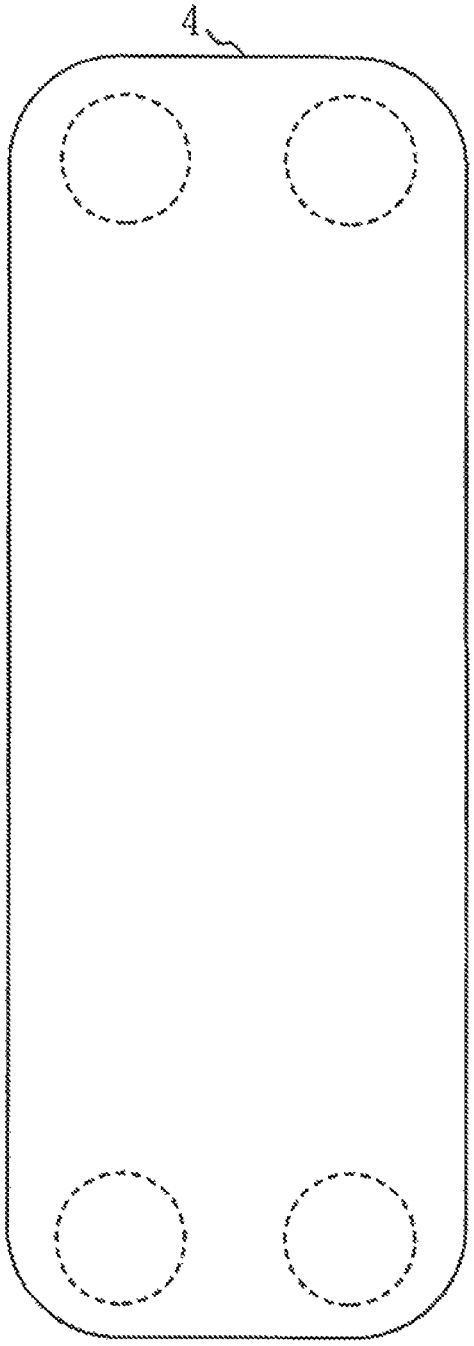
FIG. 5 is a front view of a reinforcing side plate 4.
Figure 6:
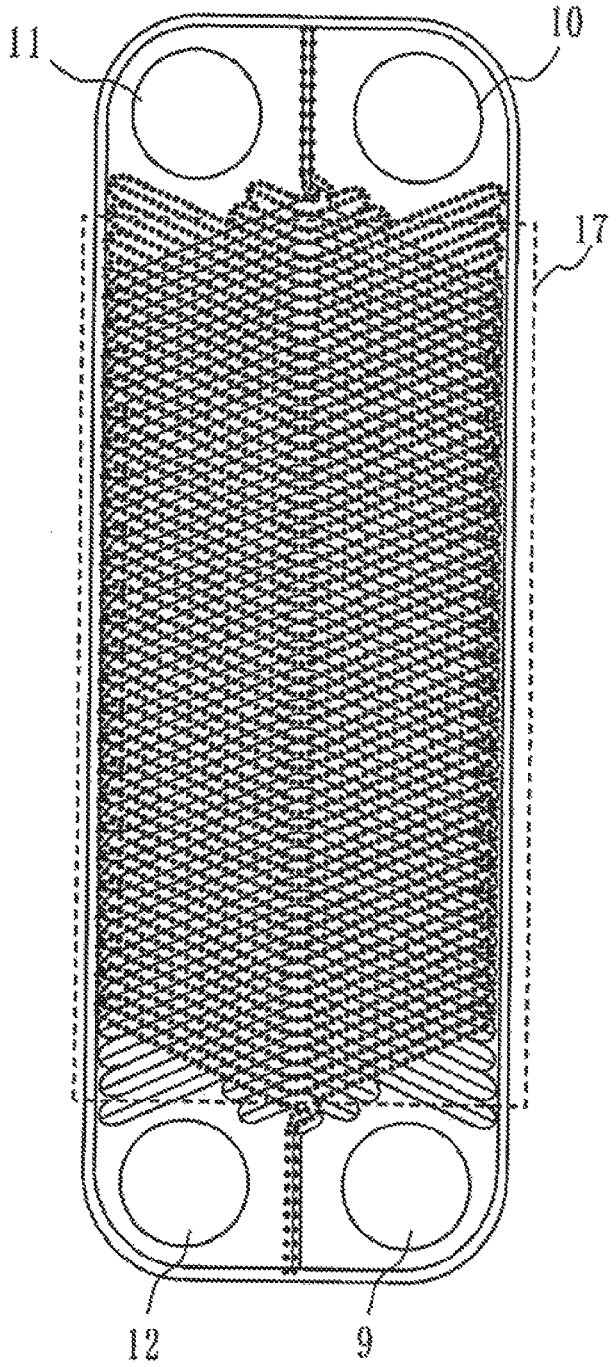
FIG. 6 is a diagram illustrating a state where the heat transfer plate 2 and the heat transfer plate 3 are stacked.
Figure 7:
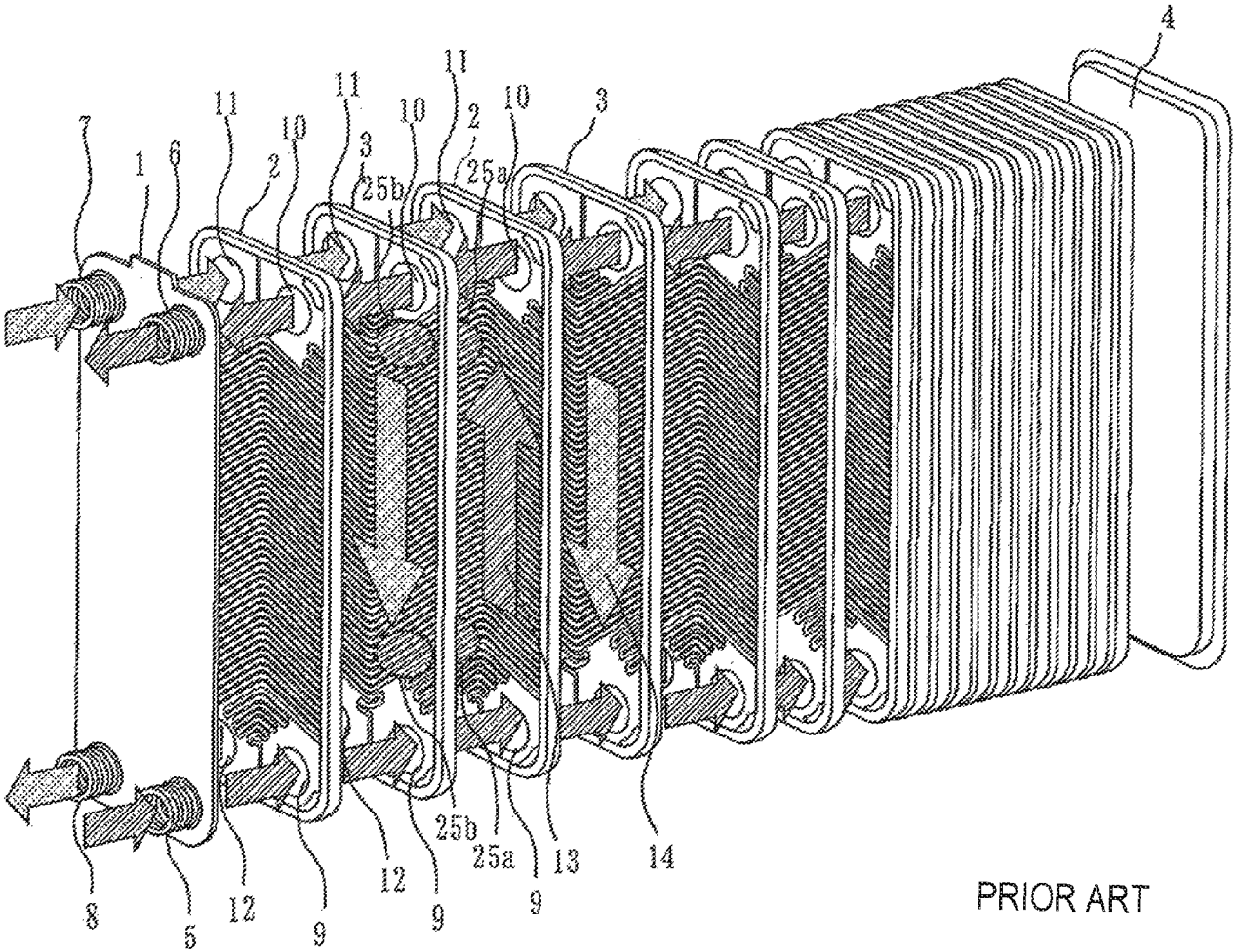
PRIOR ART FIG. 7
FIG. 7 is an exploded perspective view of the plate heat exchanger 50.
Figure 8:
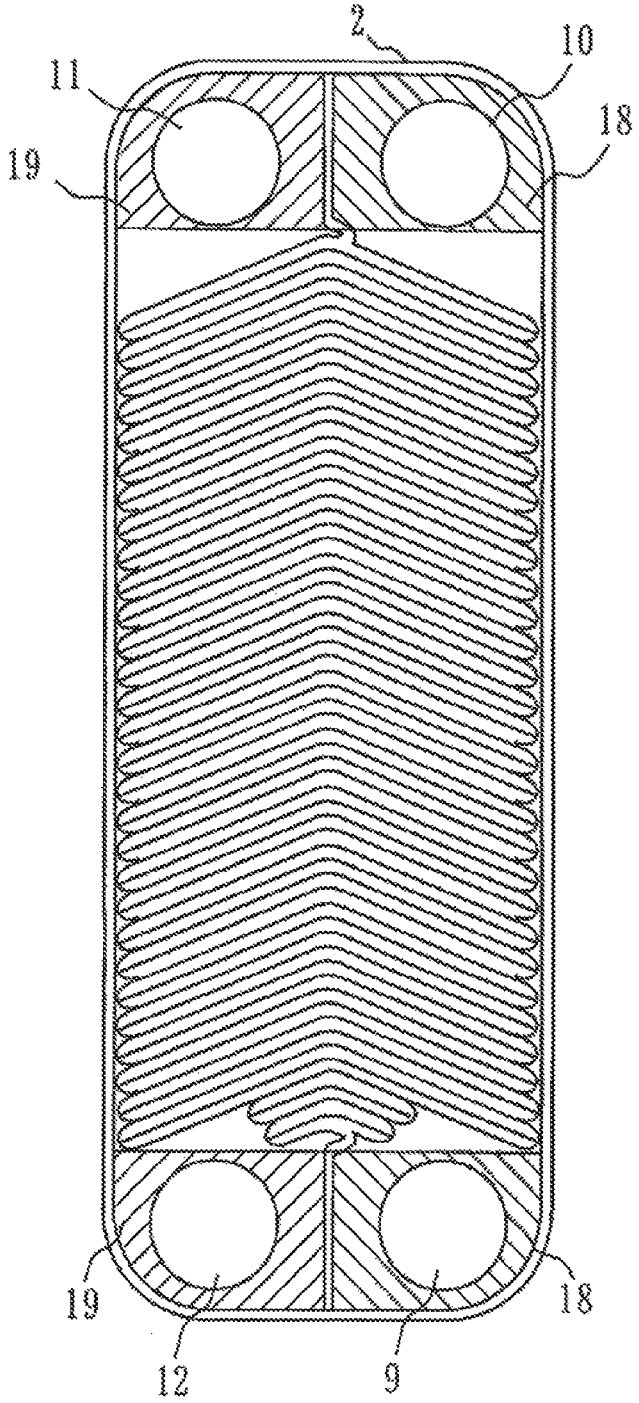
FIG. 8 is a diagram illustrating the shape of the heat transfer plate 2.
Figure 9:
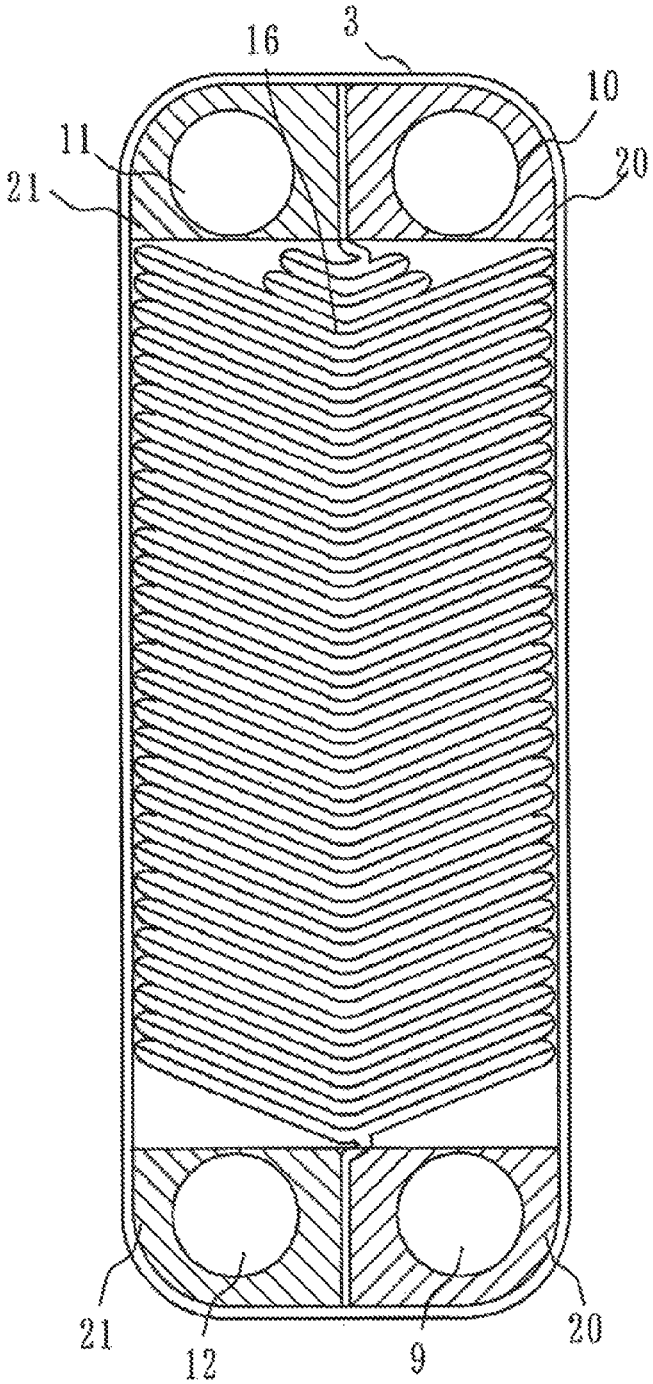
FIG. 9 is a diagram illustrating the shape of the heat transfer plate 3.

FIG. 1 is a side view of the plate heat exchanger 50. FIG. 2 is a front view of a reinforcing side plate 1 (seen in a stacking direction). FIG. 3 is a front view of a heat transfer plate 2. FIG. 4 is a front view of a heat transfer plate 3. FIG. 5 is a front view of a reinforcing side plate 4. FIG. 6 is a diagram illustrating a state where the heat transfer plate 2 and the heat transfer plate 3 are stacked. FIG. 7 is an exploded perspective view of the plate heat exchanger 50. FIG. 8 is a diagram illustrating the shape of the heat transfer plate 2. FIG. 9 is a diagram illustrating the shape of the heat transfer plate 3.

As illustrated in FIG. 1, the plate heat exchanger 50 includes heat transfer plates 2 and heat transfer plates 3 that are alternately stacked. The plate heat exchanger 50 further includes the reinforcing side plate 1 provided on the frontmost side thereof and the reinforcing side plate 4 provided on the rearmost side thereof.

As illustrated in FIG. 2, the reinforcing side plate 1 has a substantially rectangular plate shape. The reinforcing side plate 1 is provided with a first inflow pipe 5, a first outflow pipe 6, a second inflow pipe 7, and a second outflow pipe 8 at the four respective corners of the substantially rectangular shape thereof.

As illustrated in FIGS. 3 and 4, each of the heat transfer plates 2 and 3 has a substantially rectangular plate shape, as with the reinforcing side plate 1, and has a first inlet 9, a first outlet 10, a second inlet 11, and a second outlet 12 at the four respective corners thereof. The heat transfer plates 2 and 3 have respective wavy portions 15 and 16 displaced in the plate stacking direction. The wavy portions 15 and 16 each have a substantially V shape when seen in the stacking direction. Note that the substantially V shape of the wavy portion 15 included in the heat transfer plate 2 and the substantially V shape of the wavy portion 16 included in the heat transfer plate 3 are inverse to each other.

As illustrated in FIG. 5, the reinforcing side plate 4 has a substantially rectangular plate shape, as with the reinforcing side plate 1 and so forth. The reinforcing side plate 4 is provided with none of the first inflow pipe 5, the first outflow pipe 6, the second inflow pipe 7, and the second outflow pipe 8. In FIG. 5, positions corresponding to the first inflow pipe 5, the first outflow pipe 6, the second inflow pipe 7, and the second outflow pipe 8 are represented by broken lines and indicated on the reinforcing side plate 4; however, this does not mean that the reinforcing side plate 4 is provided with them.

As illustrated in FIG. 6, when the heat transfer plate 2 and the heat transfer plate 3 are stacked, the wavy portions 15 and 16 having the substantially V shapes that are inverse to each other meet each other, whereby a passage that produces a complex flow is formed between the heat transfer plate 2 and the heat transfer plate 3.

As illustrated in FIG. 7, the heat transfer plates 2 and 3 are stacked such that the respective first inlets 9, the respective first outlets 10, the respective second inlets 11, and the respective second outlets 12 meet each other. The reinforcing side plate 1 and the heat transfer plate 2 are stacked such that the first inflow pipe 5 and the first inlet 9 meet each other, the first outflow pipe 6 and the first outlet 10 meet each other, the second inflow pipe 7 and the second inlet 11 meet each other, and the second outflow pipe 8 and the second outlet 12 meet each other. The heat transfer plates 2 and 3 and the reinforcing side plates 1 and 4 are stacked such that the outer circumferential edges thereof meet one another, and are bonded to one another by brazing or the like. The heat transfer plates 2 and 3 are bonded not only at the outer circumferential edges thereof but also at positions where, when seen in the stacking direction, the bottoms of the wavy portions of one of the plates that is on the upper side and the tops of the wavy portions of the other plate that is on the lower side meet each other.

In this manner, a first passage 13 in which a first fluid (such as water) having flowed from the first inflow pipe 5 flows out of the first outflow pipe 6 is formed between the back side of the heat transfer plate 3 and the front side of the heat transfer plate 2. Likewise, a second passage 14 in which a second fluid (such as a refrigerant) having flowed from the second inflow pipe 7 flows out of the second outflow pipe 8 is formed between the back side of the heat transfer plate 2 and the front side of the heat transfer plate 3.

The first fluid having flowed from the outside into the first inflow pipe 5 flows through a passage hole formed by meeting the first inlets 9 of the respective heat transfer plates 2 and 3 each other, and flows out of the first passage 13. The first fluid having flowed into the first passage 13 flows in the long-side direction while gradually spreading in the short-side direction and flows out of the first outlet 10. The first fluid having flowed out of the first outlet 10 flows through a passage hole formed by meeting the first outlets 10 each other, and flows out of the first outflow pipe 6 to the outside.

Likewise, the second fluid having flowed from the outside into the second inflow pipe 7 flows through a passage hole formed by meeting the second inlets 11 of the respective heat transfer plates 2 and 3 each other, and flows into the second passage 14. The second fluid having flowed into the second passage 14 flows in the long-side direction while gradually spreading in the short-side direction and flows out of the second outlet 12. The second fluid having flowed out of the second outlet 12 flows through a passage hole formed by meeting the second outlets 12 each other, and flows out of the second outflow pipe 8 to the outside.

The first fluid that flows through the first passage 13 and the second fluid that flows through the second passage 14 exchange heat therebetween via the heat transfer plates 2 and 3 when flowing through areas where the wavy portions 15 and 16 are formed. The areas of the first passage 13 and the second passage 14 where the respective wavy portions 15 and 16 are formed are referred to as heat-exchanging passages 17 (see FIGS. 3, 4, and 6).

As illustrated in FIG. 8, hatched portions 18 of the heat transfer plate 2 around the first inlet 9 and the first outlet 10 are at substantially the same level as the bottom of the wavy portion 15, and hatched portions 19 of the heat transfer plate 2 around the second inlet 11 and the second outlet 12 are at substantially the same level as the top of the wavy portion 15.

Likewise, as illustrated in FIG. 9, hatched portions 20 of the heat transfer plate 3 around the first inlet 9 and the first outlet 10 are at substantially the same level as the top of the wavy portion 16, and hatched portions 21 of the heat transfer plate 3 around the second inlet 11 and the second outlet 12 are at substantially the same level as the bottom of the wavy portion 16.

When such heat transfer plates 2 and heat transfer plates 3 are alternately stacked, the back side of each heat transfer plate 3 and the front side of each heat transfer plate 2 are positioned with each of the hatched portions 21 of the heat transfer plate 3 and a corresponding one of the hatched portions 19 of the heat transfer plate 2 being closely in contact with each other. Meanwhile, a space is formed between each of the hatched portions 20 of the heat transfer plate 3 and a corresponding one of the hatched portions 18 of the heat transfer plate 2. Hence, the first fluid flowing through the first inlet 9 flows into the first passage 13 formed between the back side of the heat transfer plate 3 and the front side of the heat transfer plate 2, whereas the second fluid flowing through the second inlet 11 does not flow into the first passage 13. Furthermore, the first fluid flowing through the first passage 13 does not flow into the second inlet 11 or the second outlet 12.

Likewise, the back side of each heat transfer plate 2 and the front side of each heat transfer plate 3 are positioned with each of the hatched portions 18 of the heat transfer plate 2 and a corresponding one of the hatched portions 20 of the heat transfer plate 3 being closely in contact with each other. Meanwhile, a space is formed between each of the hatched portions 19 of the heat transfer plate 2 and a corresponding one of the hatched portions 21 of the heat transfer plate 3. Hence, the second fluid flowing through the second inlet 11 flows into the second passage 14 formed between the back side of the heat transfer plate 2 and the front side of the heat transfer plate 3, whereas the first fluid flowing through the first inlet 9 does not flow into the second passage 14. Furthermore, the second fluid flowing through the second passage 14 does not flow into the first inlet 9 or the first outlet 10.

In the first passage 13, the hatched portions 19 and the hatched portions 21 are in close contact with each other, where the passage is sealed. Hence, it is difficult for the first fluid to flow and the first fluid tends to stagnate in areas of the heat-exchanging passage 17 in the first passage 13 around the second inlet 11 and the second outlet 12 (broken-lined portions 25*a* illustrated in FIG. 7).

Likewise, in the second passage 14, the hatched portions 18 and the hatched portions 20 are in close contact with each other, where the passage is sealed. Hence, it is difficult for the second fluid to flow and the second fluid tends to stagnate in areas of the heat-exchanging passage 17 in the second passage 14 around the first inlet 9 and the first outlet 10 (broken-lined portions 25*b* illustrated in FIG. 7).

Features of the plate heat exchanger 50 according to Embodiment 1 will now be described.

Figure 10:
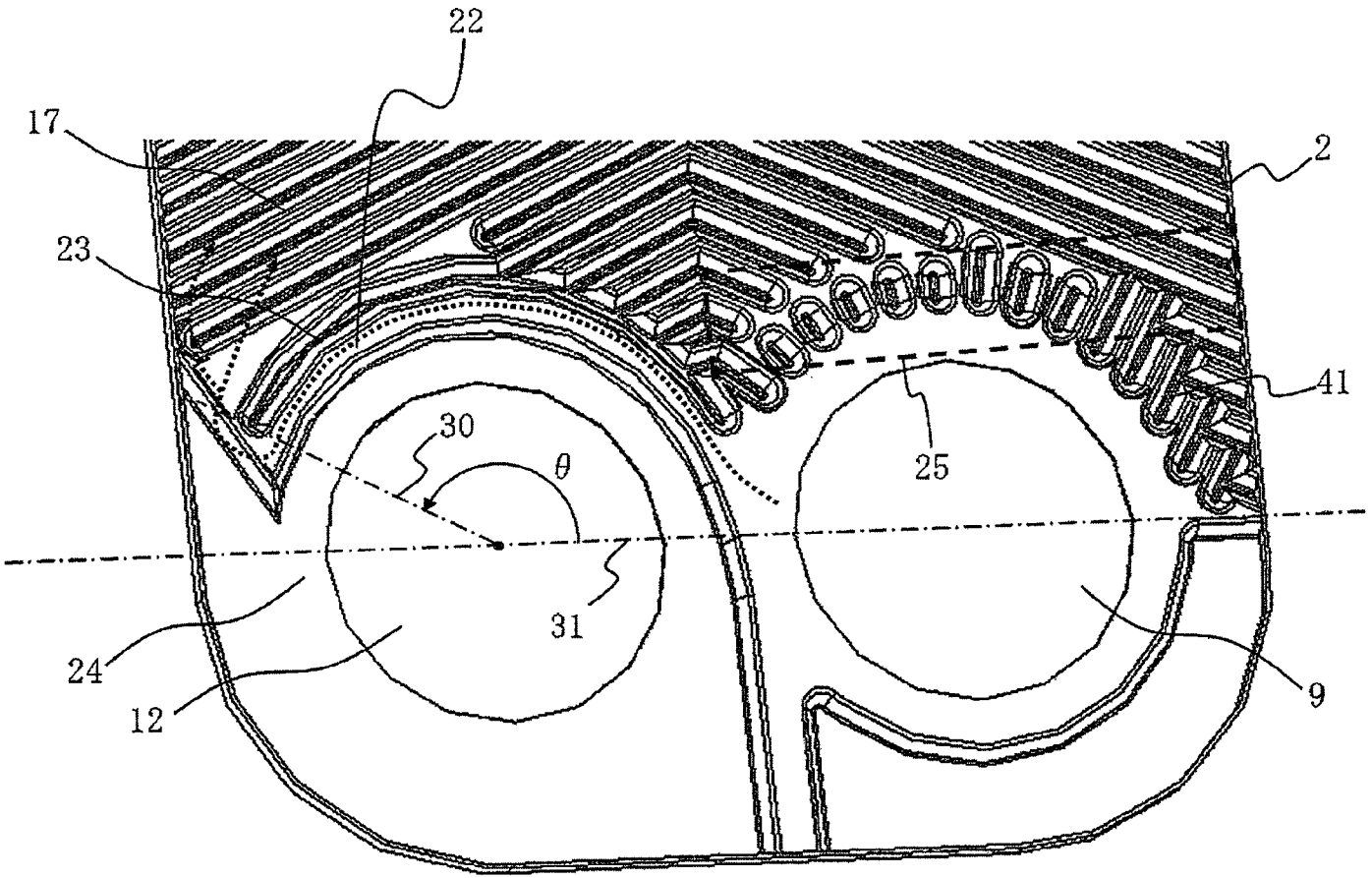
FIG. 10 is a diagram of the heat transfer plate 2 according to Embodiment 1.

FIG. 10 is a diagram of the heat transfer plate 2 according to Embodiment 1.

The plate heat exchanger 50 according to Embodiment 1 is characterized in including a bypass passage 22 (upstream-side bypass passage) formed in the first passage 13 and extending along the second outlet 12 (upstream-side adjacent hole).

As illustrated in FIG. 10, the heat transfer plate 2 includes a wavy portion 23 extending from an inlet peripheral portion, which is an area around the first inlet 9, to a long-side-peripheral area, which is an area around one of the long sides of the heat transfer plate 2 that is nearer to the second outlet 12. The wavy portion 23 is displaced in the plate stacking direction. The wavy portion 23 has a ridge line at the top of the wave that extends along the second outlet 12. In the state where the heat transfer plates 2 and 3 are stacked, the bypass passage 22 is formed between the wavy portion 23 and a sealed portion 24 where the area around the second outlet 12 is sealed in combination with the heat transfer plate 3. The sealed portion 24 corresponds to one of the hatched portions 19 illustrated in FIG. 8.

The bypass passage 22 allows some of the first fluid having flowed therein from the first inlet 9 to flow from the long-side-peripheral area that is nearer to the second outlet 12 into the heat-exchanging passage 17, as illustrated by the broken-line arrows in FIG. 10. That is, with the bypass passage 22, the first fluid having flowed from the first inlet 9 into the first passage 13 flows not only from a main inflow passage 25 into the heat-exchanging passage 17 as with the typical plate heat exchanger but also from the bypass passage 22 into the heat-exchanging passage 17.

As described above, in a case where the first fluid flows only from the main inflow passage 25 into the heat-exchanging passage 17, it is difficult for the first fluid to flow and the first fluid stagnates around the second outlet 12 in the heat-exchanging passage 17. With the bypass passage 22, however, the first fluid is allowed to flow around the second outlet 12 in the heat-exchanging passage 17, whereby the occurrence of stagnation is prevented.

The cross-sectional passage area of the bypass passage 22 is gradually reduced from a side (the entrance side) thereof nearer to the first inlet 9 toward a side (the exit side) thereof nearer to the long-side-peripheral area. Hence, the speed at which the first fluid flows toward the exit side of the bypass passage 22 increases. Therefore, the first fluid is allowed to flow around the second outlet 12, where stagnation tends to occur, without the reduction in the speed of the first fluid halfway in the bypass passage 22.

Since the wavy portion 23 has a substantially curved shape extending along the second outlet 12, the bypass passage 22 also has a substantially curved shape extending along the second outlet 12. Hence, the pressure loss for the first fluid flowing through the bypass passage 22 is reduced.

The substantially curved shape referred to herein includes any of the following shapes: a shape formed of curved lines solely, a combination of curves and short straight lines, a combination of short straight lines that are connected continuously, and the like.

A case will now be taken as an example in which the first fluid is water, the second fluid is a refrigerant, and the plate heat exchanger 50 functions as an evaporator. If water stays in the first passage 13, such water is rapidly cooled by the refrigerant. Consequently, the water is frozen and undergoes cubical expansion, leading to a possibility of damage to the plate heat exchanger 50. In the plate heat exchanger 50 according to Embodiment 1, however, water does not stay in the first passage 13. Therefore, the plate heat exchanger 50 is prevented from being damaged.

Moreover, in the known art, heat is not exchanged effectively in the area where the first fluid stagnates. In contrast, in the plate heat exchanger 50 according to Embodiment 1, the area where the first fluid stagnates in the known art is free of stagnation. Hence, the effective area of heat exchange increases. Accordingly, the efficiency of heat exchange increases. Therefore, the plate heat exchanger 50 may be used not only as an evaporator but also as a condenser.

Furthermore, in a case where the plate heat exchanger 50 is included in an air-conditioning apparatus, the number of plates to be included in the plate heat exchanger 50 relative to the required capacity of the air-conditioning apparatus can be reduced because the plate heat exchanger 50 has improved heat-exchanging performance. Furthermore, as described above, freezing in the plate heat exchanger 50 is prevented, and the occurrence of damage thereto is therefore prevented. Hence, a low-cost, highly reliable plate heat exchanger 50 is provided.

Embodiment 2

In Embodiment 1, the case of providing the bypass passage 22 on the side of the first passage 13 that is nearer to the first inlet 9 has been described. In Embodiment 2, a case of providing a bypass passage 26 (downstream-side bypass passage) on a side of the first passage 13 that is nearer to the second inlet 11 (downstream-side adjacent hole) will be described.

Figure 11:
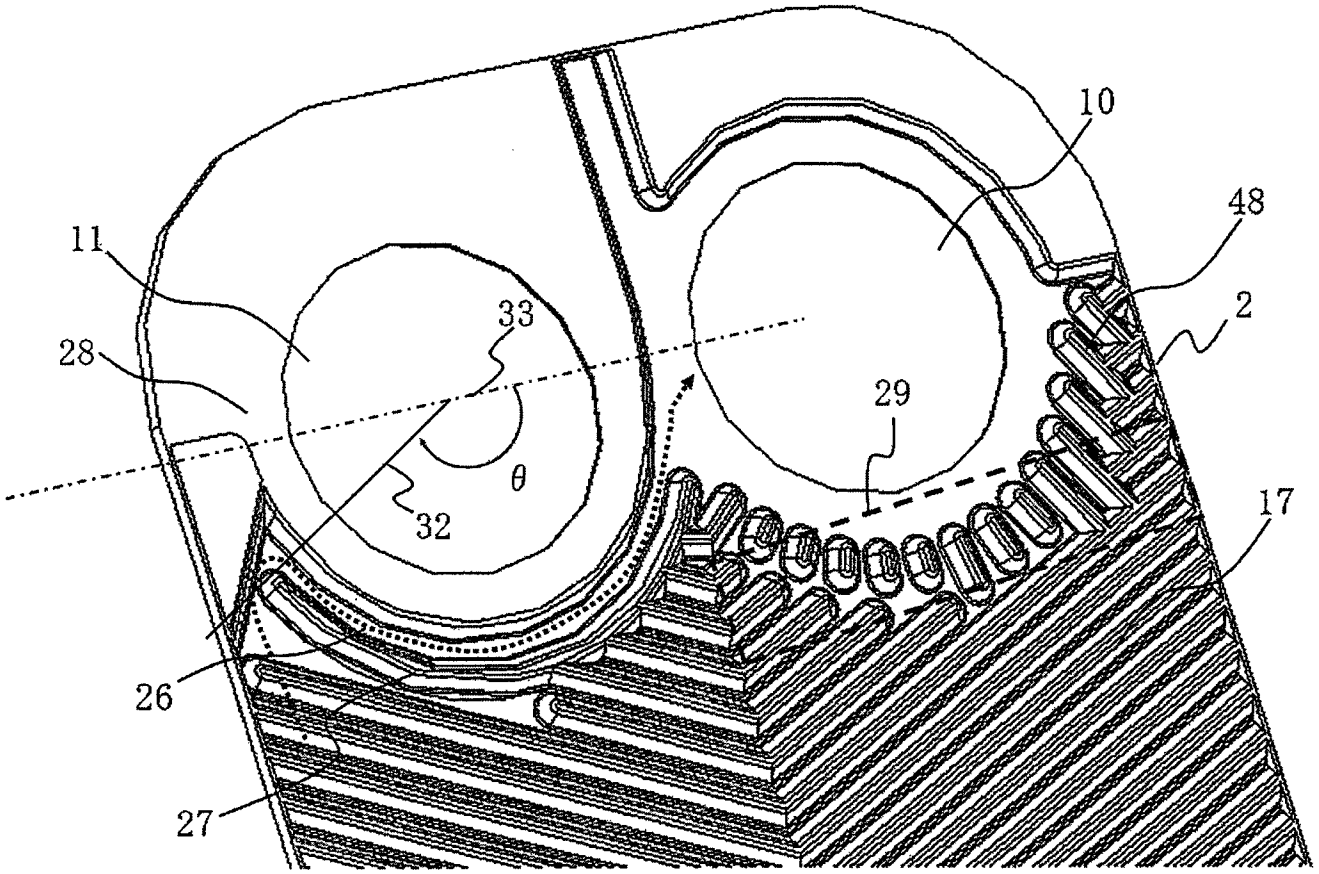
FIG. 11 is a diagram of a heat transfer plate 2 according to Embodiment 2.

FIG. 11 is a diagram of a heat transfer plate 2 according to Embodiment 2.

As illustrated in FIG. 11, the heat transfer plate 2 has a wavy portion 27 extending from a long-side-peripheral area that is on a side thereof nearer to the second inlet 11 to an outlet peripheral portion, which is an area around the first outlet 10. The wavy portion 27 is displaced in the plate stacking direction. The wavy portion 27 has a ridge line that extends along the second inlet 11. In the state where the heat transfer plates 2 and 3 are stacked, the bypass passage 26 is formed between the wavy portion 27 and a sealed portion 28 where the area around the second inlet 11 is sealed in combination with the heat transfer plate 3. The sealed portion 28 corresponds to one of the hatched portions 19 illustrated in FIG. 8.

The bypass passage 26 allows some of the first fluid flowing in the heat-exchanging passage 17 to flow from the long-side-peripheral area into the first outlet 10, as illustrated by the broken-line arrow in FIG. 11. That is, with the bypass passage 26, the first fluid flowing through the heat-exchanging passage 17 flows not only from a main outflow passage 29 into the first outlet 10 as with the typical plate heat exchanger but also from the bypass passage 26 into the first outlet 10.

As described above, in a case where the first fluid flows only from the main outflow passage 29 into the first outlet 10, it is difficult for the first fluid to flow and the first fluid stagnates around the second inlet 11 in the heat-exchanging passage 17. With the bypass passage 26, however, the first fluid is allowed to flow around the second inlet 11 in the heat-exchanging passage 17, whereby the occurrence of stagnation is prevented.

The cross-sectional passage area of the bypass passage 26 is gradually reduced from a side (the entrance side) thereof nearer to the long-side-peripheral area toward a side (the exit side) thereof nearer to the first outlet 10. Hence, the speed at which the first fluid flows toward the exit side of the bypass passage 26 increases. Therefore, the first fluid is allowed to flow around the first outlet 10 without the reduction in the speed of the first fluid halfway in the bypass passage 26.

Since the wavy portion 27 has a substantially curved shape extending along the second inlet 11, the bypass passage 26 also has a substantially curved shape extending along the second inlet 11. Hence, the pressure loss for the first fluid flowing through the bypass passage 26 is reduced.

As in Embodiment 1, the substantially curved shape referred to herein includes any of the following shapes: a shape formed of curved lines solely, a combination of curves and short straight lines, a combination of short straight lines that are connected continuously, and the like.

Thus, as in Embodiment 1, the occurrence of damage to the plate heat exchanger 50 is prevented while the effective area of heat exchange is increased. Particularly, it is effective to combine the configuration according to Embodiment 1 and the configuration according to Embodiment 2.

Embodiment 3

In Embodiments 1 and 2, the respective cases of providing the bypass passage 22 or 26 have been described. In Embodiment 3, how far the bypass passage 22 or 26 extends in an area extending along the long side will be described.

As illustrated in FIG. 10, the wavy portion 23 is configured such that a line 30 connecting an end of the ridge line of the wavy portion 23 that is nearer to the long-side-peripheral portion and the center of the second outlet 12 is at an angle θ of 90 degrees or larger and 180 degrees or smaller with respect to a line 31 that is parallel to the short side of the heat transfer plate 2. With the wavy portion 23 configured as described above, the bypass passage 22 reaches the long-side-peripheral portion that is nearer to the second outlet 12. Consequently, the first fluid is allowed to assuredly flow around the second outlet 12 in the heat-exchanging passage 17, whereby the occurrence of stagnation is avoided.

Likewise, as illustrated in FIG. 11, the wavy portion 27 is configured such that a line 32 connecting an end of the ridge line of the wavy portion 27 that is nearer to the long-side-peripheral portion and the center of the second inlet 11 is at an angle θ of 90 degrees or larger and 180 degrees or smaller with respect to a line 33 that is parallel to the short side of the heat transfer plate 2. With the wavy portion 27 configured as described above, the bypass passage 26 reaches the long-side-peripheral portion that is nearer to the second inlet 11. Consequently, the first fluid is allowed to assuredly flow from an area around the second inlet 11 to an area around the first outlet 10 in the heat-exchanging passage 17, whereby the occurrence of stagnation is avoided.

Embodiment 4

In Embodiments 1 and 2, the respective cases of providing the bypass passage 22 or 26 have been described. Embodiment 4 will now be described the shape of a wall of the bypass passage 22 or 26 that is nearer to the sealed portion 24 or 28.

Figure 12:
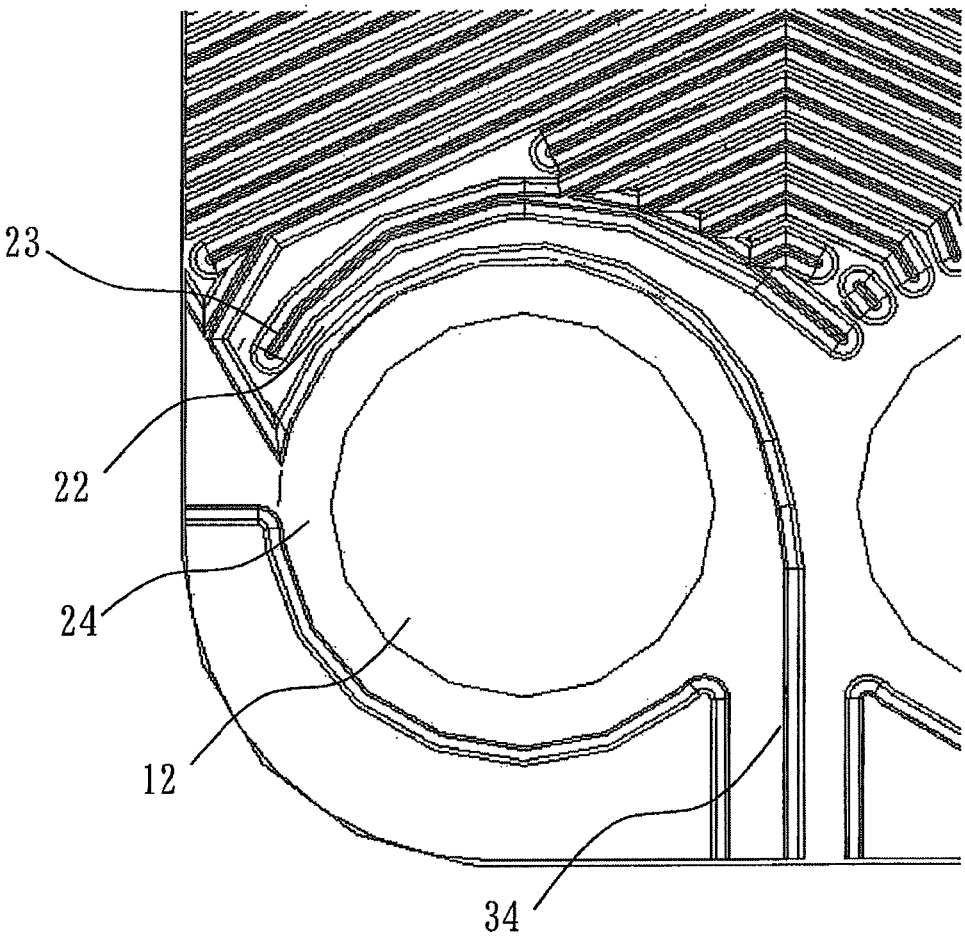
FIG. 12 is a diagram of a heat transfer plate 2 according to Embodiment 4.

FIG. 12 is a diagram of a heat transfer plate 2 according to Embodiment 4.

As described in Embodiment 1, the bypass passage 22 is formed between the sealed portion 24 and the wavy portion 23, and the wavy portion 23 has a substantially curved shape extending along the second outlet 12. Here, suppose that an edge 34 of the sealed portion 24 is formed in a substantially curved shape so as to extend in an arc shape along the second outlet 12. In such a case, a wall of the bypass passage 22 that is nearer to the second outlet 12 also has a substantially curved shape.

Consequently, the first fluid having flowed into the bypass passage 22 from the side of the first inlet 9 flows smoothly through the bypass passage 22 without producing any vortices on the wall of the bypass passage 22 that is nearer to the second outlet 12. Therefore, the pressure loss in the bypass passage 22 is reduced.

As for the bypass passage 26 also, in a case where an edge of the sealed portion 28 is formed in a substantially curved shape so as to extend in an arc shape along the second inlet 11, a wall of the bypass passage 26 that is nearer to the second inlet 11 also has a substantially curved shape. Consequently, the first fluid having flowed into the bypass passage 26 from the side of the heat-exchanging passage 17 flows smoothly through the bypass passage 26 without producing any vortices on the wall of the bypass passage 26 that is nearer to the second inlet 11. Therefore, the pressure loss in the bypass passage 26 is reduced.

Embodiment 5

In Embodiments 1 to 4, only the heat transfer plate 2 has been described. In Embodiment 5, the heat transfer plate 3 will be described.

Figure 13:
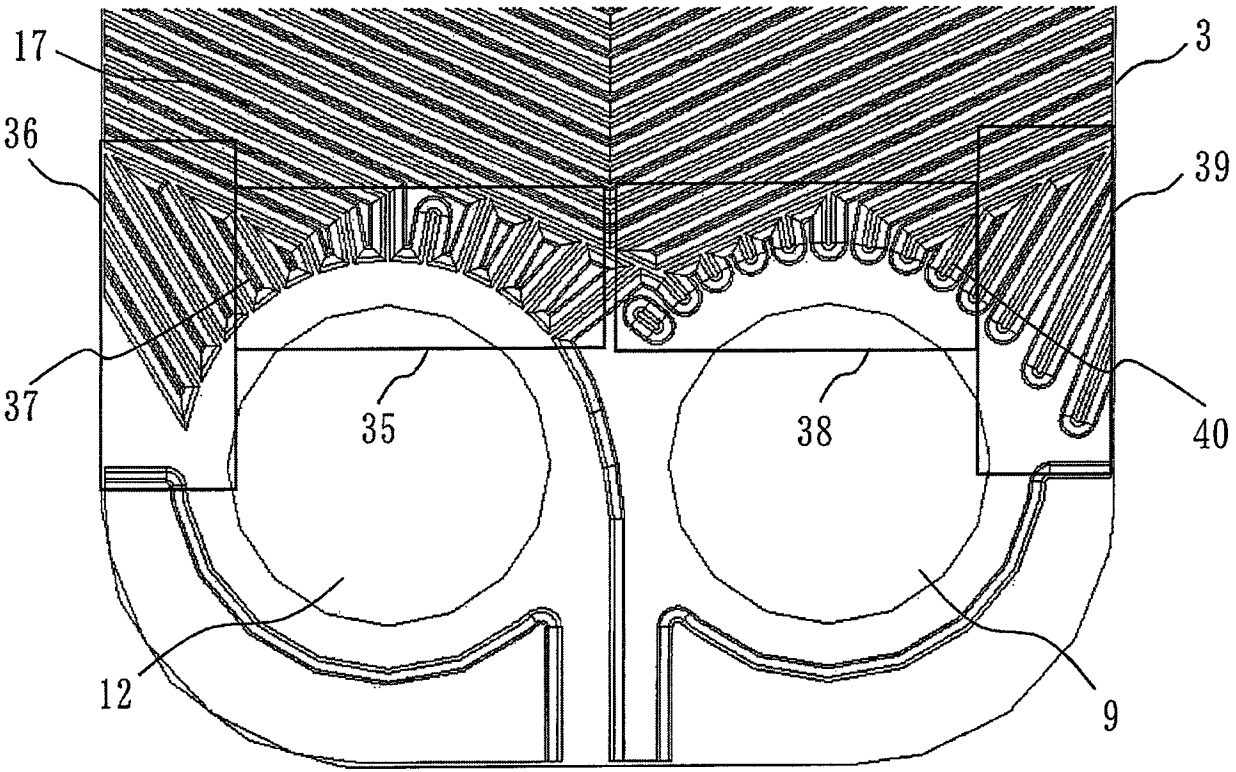
FIG. 13 is a diagram of a heat transfer plate 3 according to Embodiment 5.

FIG. 13 is a diagram of a heat transfer plate 3 according to Embodiment 5.

As illustrated in FIG. 13, the heat transfer plate 3 has, on a side of the second outlet 12 that is nearer to the heat-exchanging passage 17, a wavy portion 37 that is displaced in the plate stacking direction. The wavy portion 37 has ridge lines extending radially with respect to the center of the second outlet 12. Hence, in the state where the heat transfer plate 2 and the heat transfer plate 3 are stacked, the bypass passage 22 extending along the second outlet 12 is formed on the side of the heat transfer plate 2 and passages extending radially from the center of the second outlet 12 are formed on the side of the heat transfer plate 3 between the heat transfer plate 2 and the heat transfer plate 3.

Therefore, the first fluid having flowed into the bypass passage 22 follows the bypass passage 22 formed on the side of the heat transfer plate 2 toward the long-side-peripheral portion (toward the exit side) while some of the first fluid follows the radial passages formed on the side of the heat transfer plate 3 and spreads radially into the heat-exchanging passage 17.

Particularly, in a near-center area 35 of the heat transfer plate 3 in the short-side direction, the ridge lines of the wavy portion 37 extend radially with respect to the center of the second outlet 12. In a long-side-peripheral portion 36 of the heat transfer plate 3, the ridge lines of the wavy portion 37 are oriented in a direction closer to the long-side direction than the radial direction. In the near-center area 35, the radially extending passages cause the first fluid to spread radially before flowing into the heat-exchanging passage 17. Meanwhile, in the long-side-peripheral portion 36, the speed of flow of the first fluid is reduced. Therefore, the ridge lines of the wavy portion 37 are oriented in a direction closer to the long-side direction than the radial direction so as to provide passages extending in the long-side direction, whereby the speed of flow of the first fluid in the long-side direction is increased. In this manner, the speed of flow of the first fluid in the long-side direction can be generally made almost uniform. Consequently, the occurrence of stagnation in the long-side-peripheral portion 36 where the first fluid flows with difficulty is avoided, and the pressure loss is reduced.

The heat transfer plate 3 also has, on a side of the first inlet 9 that is nearer to the heat-exchanging passage 17, a wavy portion 40 that is displaced in the plate stacking direction. The wavy portion 40 has ridge lines extending radially with respect to the center of the first inlet 9. As illustrated in FIG. 10, the heat transfer plate 2 also has, on a side of the first inlet 9 that is nearer to the heat-exchanging passage 17, a wavy portion 41 that is displaced in the plate stacking direction. The wavy portion 41 has ridge lines extending radially with respect to the center of the first inlet 9. Hence, in the state where the heat transfer plate 2 and the heat transfer plate 3 are stacked, passages extending radially from the center of the first inlet 9 are formed between the heat transfer plate 2 and the heat transfer plate 3.

Therefore, most of the first fluid having flowed from the first inlet 9 follows the radial passages while spreading radially and flows from the main inflow passage 25 into the heat-exchanging passage 17.

As with the case on the side of the second outlet 12, in a near-center area 38 of each of the heat transfer plates 2 and 3 in the short-side direction, the ridge lines of the wavy portion 40 or 41 extend radially with respect to the center of the first inlet 9. In a long-side-peripheral portion 39 of each of the heat transfer plates 2 and 3, the ridge lines of the wavy portion 40 or 41 are oriented in a direction closer to the long-side direction than the radial direction.

Embodiment 6

In Embodiment 5, the configuration on the side of the heat transfer plate 3 having the first inlet 9 and the second outlet 12 has been described. In Embodiment 6, a configuration on the side of the heat transfer plate 3 having the first outlet 10 and the second inlet 11 will be described.

The configuration on the side of the heat transfer plate 3 having the first outlet 10 and the second inlet 11 is the same as the configuration on the side of the heat transfer plate 3 having the first inlet 9 and the second outlet 12 described in Embodiment 5.

Figure 14:
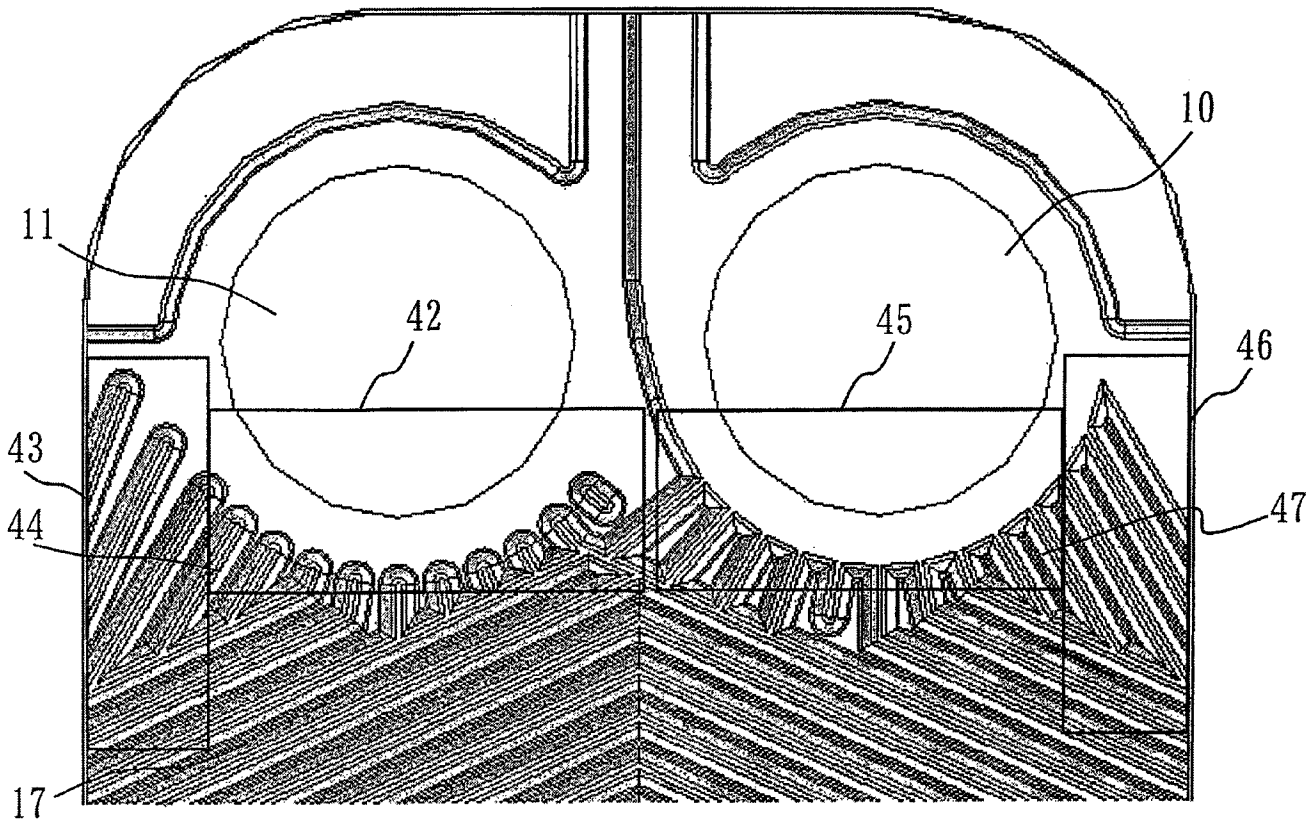
FIG. 14 is a diagram of a heat transfer plate 3 according to Embodiment 6.

FIG. 14 is a diagram of a heat transfer plate 3 according to Embodiment 6.

As illustrated in FIG. 14, the heat transfer plate 3 has, on a side of the second inlet 11 that is nearer to the heat-exchanging passage 17, a wavy portion 44 that is displaced in the plate stacking direction. The wavy portion 44 has ridge lines extending radially with respect to the center of the second inlet 11. Hence, in the state where the heat transfer plate 2 and the heat transfer plate 3 are stacked, the bypass passage 26 extending along the second inlet 11 is formed on the heat transfer plate 2 and passages extending radially from the center of the second inlet 11 are formed on the side of the heat transfer plate 3 between the heat transfer plate 2 and the heat transfer plate 3.

Therefore, the first fluid flows into the bypass passage 26, which is formed on the side of the heat transfer plate 2, not only from the side (the entrance side) of the bypass passage 26 that is nearer to the long-side-peripheral portion but also along the radial passages formed on the side of the heat transfer plate 3. The first fluid having flowed into the bypass passage 26 follows the bypass passage 26 and flows toward the first outlet 10.

Particularly, in a near-center area 42 of the heat transfer plate 3 in the short-side direction, the ridge lines of the wavy portion 44 extend radially with respect to the center of the second inlet 11. In a long-side-peripheral portion 43 of the heat transfer plate 3, the ridge lines of the wavy portion 44 are oriented in a direction closer to the long-side direction than the radial direction. In the near-center area 42, the radially extending passages cause the first fluid flowing radially in the heat-exchanging passage 17 to converge. Meanwhile, in the long-side-peripheral portion 43, the speed of flow of the first fluid is reduced. Therefore, the ridge lines of the wavy portion 44 are oriented in a direction closer to the long-side direction than the radial direction so as to form passages extending in the long-side direction, whereby the speed of flow of the first fluid in the long-side direction is increased. In this manner, the speed of flow of the first fluid in the long-side direction can be generally made almost uniform. Consequently, the occurrence of stagnation in the long-side-peripheral portion 43 where the first fluid flows with difficulty is avoided, and the pressure loss is reduced.

The heat transfer plate 3 also has, on a side of the first outlet 10 that is nearer to the heat-exchanging passage 17, a wavy portion 47 that is displaced in the plate stacking direction. The wavy portion 47 has ridge lines extending radially with respect to the center of the first outlet 10. As illustrated in FIG. 11, the heat transfer plate 2 also has, on a side of the first outlet 10 that is nearer to the heat-exchanging passage 17, a wavy portion 48 that is displaced in the plate stacking direction. The wavy portion 48 has ridge lines extending radially with respect to the center of the first outlet 10. Hence, in the state where the heat transfer plate 2 and the heat transfer plate 3 are stacked, passages extending radially from the center of the first outlet 10 are formed between the heat transfer plate 2 and the heat transfer plate 3.

Therefore, most of the first fluid flowing in the heat-exchanging passage 17 follows the radial passages and radially converges from the main outflow passage 29 into the first outlet 10.

As with the case on the side of the second inlet 11, in a near-center area 45 of each of the heat transfer plates 2 and 3 in the short-side direction, the ridge lines of the wavy portion 47 or 48 extend radially with respect to the center of the first outlet 10. In a long-side-peripheral portion 46 of each of the heat transfer plates 2 and 3, the ridge lines of the wavy portion 47 or 48 are oriented in a direction closer to the long-side direction than the radial direction.

Embodiment 7

In Embodiment 7, an exemplary circuit configuration of a heat pump apparatus 100 including the plate heat exchanger 50 will be described.

In the heat pump apparatus 100, a refrigerant such as $CO_2$, R410A, HC, or the like is used. Some refrigerants, such as $CO_2$, have their supercritical ranges on the high-pressure side. Herein, a case where R410A is used as a refrigerant will be described.

Figure 15:
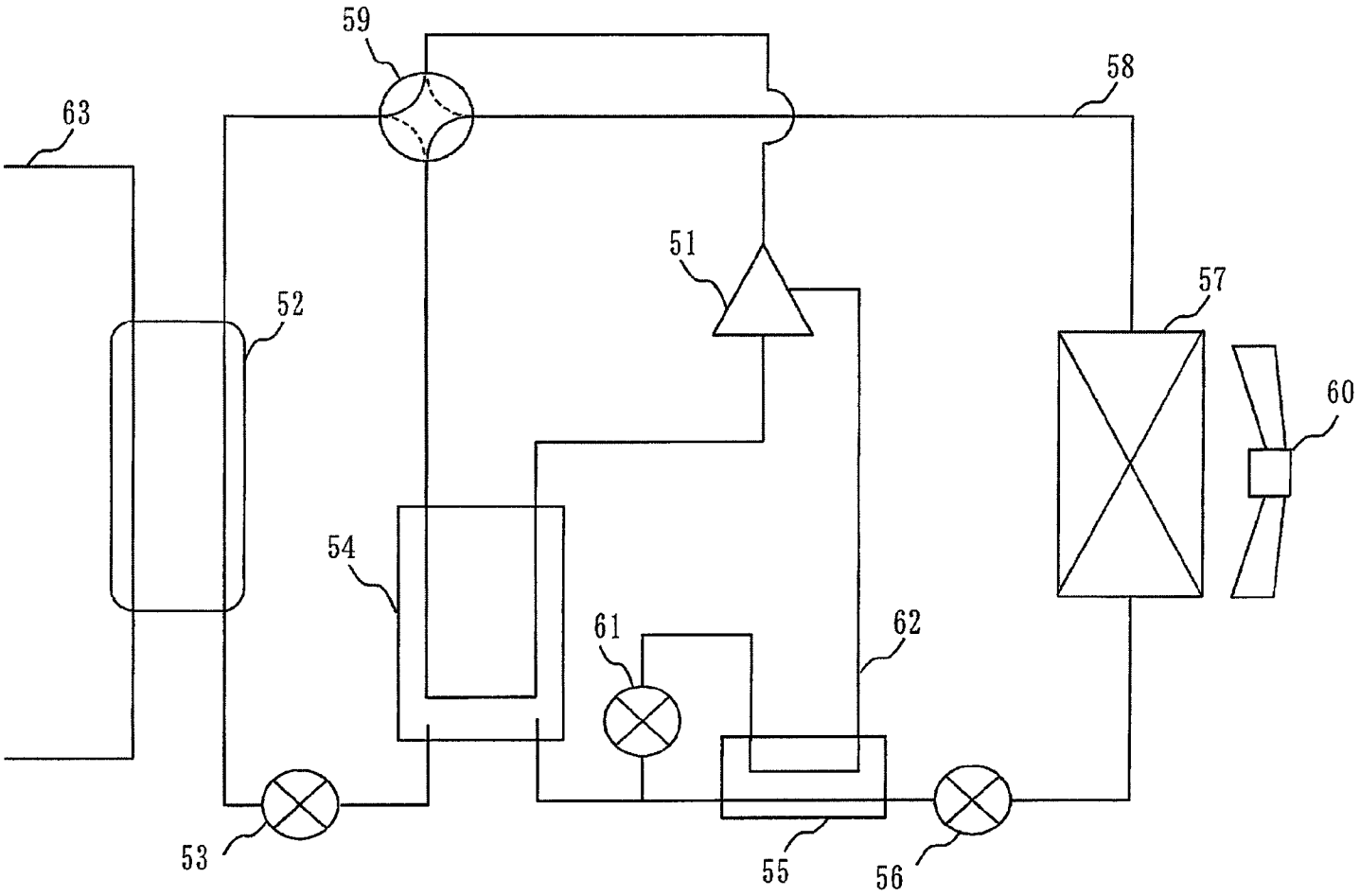
FIG. 15 is a circuit diagram of a heat pump apparatus 100 according to Embodiment 7.

FIG. 15 is a circuit diagram of the heat pump apparatus 100 according to Embodiment 7.

Figure 16:
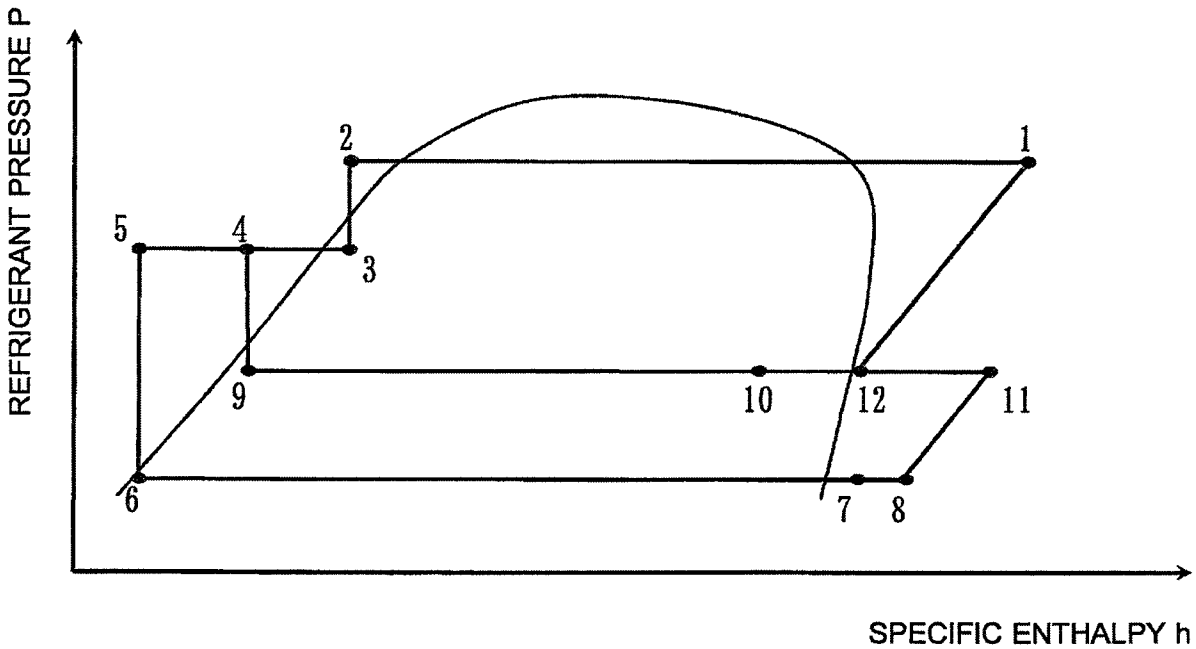
FIG. 16 is a Mollier chart illustrating the state of a refrigerant in the heat pump apparatus 100 illustrated in FIG. 15.

FIG. 16 is a Mollier chart illustrating the state of the refrigerant in the heat pump apparatus 100 illustrated in FIG. 15. In FIG. 16, the horizontal axis represents specific enthalpy, and the vertical axis represents refrigerant pressure.

The heat pump apparatus 100 includes a main refrigerant circuit 58 through which the refrigerant circulates. The main refrigerant circuit 58 includes a compressor 51, a heat exchanger 52, an expansion mechanism 53, a receiver 54, an internal heat exchanger 55, an expansion mechanism 56, and a heat exchanger 57 that are connected sequentially with pipes. In the main refrigerant circuit 58, a four-way valve 59 is provided on the discharge side of the compressor 51 and enables switching of the direction of refrigerant circulation. Furthermore, a fan 60 is provided near the heat exchanger 57. The heat exchanger 52 corresponds to the plate heat exchanger 50 according to any of the embodiments described above.

The heat pump apparatus 100 further includes an injection circuit 62 that connects a point between the receiver 54 and the internal heat exchanger 55 and an injection pipe of the compressor 51 with pipes. In the injection circuit 62, an expansion mechanism 61 and the internal heat exchanger 55 are connected sequentially.

The heat exchanger 52 is connected to a water circuit 63 through which water circulates. The water circuit 63 is connected to an apparatus that uses water, such as a water heater, a radiating apparatus as a radiator or for floor heating, or the like.

A heating operation performed by the heat pump apparatus 100 will first be described. In the heating operation, the four-way valve 59 is set as illustrated by the solid lines. The heating operation referred to herein includes heating for air conditioning and water heating for making hot water by giving heat to water.

A gas-phase refrigerant (point 1 in FIG. 16) having a high temperature and a high pressure in the compressor 51 is discharged from the compressor 51 and undergoes heat exchange in the heat exchanger 52 functioning as a condenser and a radiator, whereby the gas-phase refrigerant is liquefied (point 2 in FIG. 16). In this step, heat that has been transferred from the refrigerant heats the water circulating through the water circuit 63. The heated water is used for heating or water heating.

The liquid-phase refrigerant obtained through the liquefaction in the heat exchanger 52 is subjected to pressure reduction in the expansion mechanism 53 and falls into a two-phase gas-liquid state (point 3 in FIG. 16). The two-phase gas-liquid refrigerant obtained in the expansion mechanism 53 exchanges heat, in the receiver 54, with a refrigerant that is sucked into the compressor 51, whereby the two-phase gas-liquid refrigerant is cooled and liquefied (point 4 in FIG. 16). The liquid-phase refrigerant obtained through the liquefaction in the receiver 54 splits and flows into the main refrigerant circuit 58 and the injection circuit 62.

The liquid-phase refrigerant flowing through the main refrigerant circuit 58 exchanges heat, in the internal heat exchanger 55, with a two-phase gas-liquid refrigerant obtained through the pressure reduction in the expansion mechanism 61 and flowing through the injection circuit 62, whereby the liquid-phase refrigerant is further cooled (point 5 in FIG. 16). The liquid-phase refrigerant having been cooled in the internal heat exchanger 55 is subjected to pressure reduction in the expansion mechanism 56 and falls into a two-phase gas-liquid state (point 6 in FIG. 16). The two-phase gas-liquid refrigerant obtained in the expansion mechanism 56 exchanges heat with the outside air in the heat exchanger 57 functioning as an evaporator and is thus heated (point 7 in FIG. 16). The refrigerant thus heated in the heat exchanger 57 is further heated in the receiver 54 (point 8 in FIG. 16) and is sucked into the compressor 51.

Meanwhile, as described above, the refrigerant flowing through the injection circuit 62 is subjected to pressure reduction in the expansion mechanism 61 (point 9 in FIG. 16) and undergoes heat exchange in the internal heat exchanger 55 (point 10 in FIG. 16). The two-phase gas-liquid refrigerant (an injection refrigerant) obtained through the heat exchange in the internal heat exchanger 55 remains in the two-phase gas-liquid state and flows through the injection pipe of the compressor 51 into the compressor 51.

In the compressor 51, the refrigerant (point 8 in FIG. 16) having been sucked from the main refrigerant circuit 58 is compressed to an intermediate pressure and is heated (point 11 in FIG. 16). The refrigerant having been compressed to an intermediate pressure and having been heated (point 11 in FIG. 16) merges with the injection refrigerant (point 10 in FIG. 16), whereby the temperature drops (point 12 in FIG. 16). The refrigerant having a dropped temperature (point 12 in FIG. 16) is further compressed and heated to have a high temperature and a high pressure, and is then discharged (point 1 in FIG. 16).

In a case where an injection operation is not performed, the opening degree of the expansion mechanism 61 is set fully closed. That is, in a case where the injection operation is performed, the opening degree of the expansion mechanism 61 is larger than a predetermined opening degree. In contrast, in the case where the injection operation is not performed, the opening degree of the expansion mechanism 61 is made smaller than the predetermined opening degree. This prevents the refrigerant from flowing into the injection pipe of the compressor 51.

The opening degree of the expansion mechanism 61 is electronically controlled by a controller such as a microcomputer.

A cooling operation performed by the heat pump apparatus 100 will now be described. In the cooling operation, the four-way valve 59 is set as illustrated by the broken lines. The cooling operation referred to herein includes cooling for air conditioning, cooling for making cold water by receiving heat from water, refrigeration, and the like.

A gas-phase refrigerant (point 1 in FIG. 16) having a high temperature and a high pressure in the compressor 51 is discharged from the compressor 51 and undergoes heat exchange in the heat exchanger 57 functioning as a condenser and a radiator, whereby the gas-phase refrigerant is liquefied (point 2 in FIG. 16). The liquid-phase refrigerant obtained through the liquefaction in the heat exchanger 57 is subjected to pressure reduction in the expansion mechanism 56 and falls into a two-phase gas-liquid state (point 3 in FIG. 16). The two-phase gas-liquid refrigerant obtained in the expansion mechanism 56 undergoes heat exchange in the internal heat exchanger 55, thereby being cooled and liquefied (point 4 in FIG. 16). In the internal heat exchanger 55, the two-phase gas-liquid refrigerant obtained in the expansion mechanism 56 and another two-phase gas-liquid refrigerant (point 9 in FIG. 16) obtained through the pressure reduction, in the expansion mechanism 61, of the liquid-phase refrigerant having been liquefied in the internal heat exchanger 55 exchange heat therebetween. The liquid-phase refrigerant (point 4 in FIG. 16) having undergone heat exchange in the internal heat exchanger 55 splits and flows into the main refrigerant circuit 58 and the injection circuit 62.

The liquid-phase refrigerant flowing through the main refrigerant circuit 58 exchanges heat, in the receiver 54, with the refrigerant that is sucked into the compressor 51, whereby the liquid-phase refrigerant is further cooled (point 5 in FIG. 16). The liquid-phase refrigerant having been cooled in the receiver 54 is subjected to pressure reduction in the expansion mechanism 53 and falls into a two-phase gas-liquid state (point 6 in FIG. 16). The two-phase gas-liquid refrigerant obtained in the expansion mechanism 53 undergoes heat exchange in the heat exchanger 52 functioning as an evaporator, and is thus heated (point 7 in FIG. 16). In this step, since the refrigerant receives heat, the water circulating through the water circuit 63 is cooled and is used for cooling or refrigeration.

The refrigerant having been heated in the heat exchanger 52 is further heated in the receiver 54 (point 8 in FIG. 16) and is sucked into the compressor 51.

Meanwhile, as described above, the refrigerant flowing through the injection circuit 62 is subjected to pressure reduction in the expansion mechanism 61 (point 9 in FIG. 16) and undergoes heat exchange in the internal heat exchanger 55 (point 10 in FIG. 16). The two-phase gas-liquid refrigerant (injection refrigerant) obtained through heat exchange in the internal heat exchanger 55 remains in the two-phase gas-liquid state and flows into the injection pipe of the compressor 51.

The compressing operation in the compressor 51 is the same as that for the heating operation.

In the case where the injection operation is not performed, the opening degree of the expansion mechanism 61 is set fully closed as in the case of the heating operation so that the refrigerant does not flow into the injection pipe of the compressor 51.

REFERENCE SIGNS LIST

1, 4 reinforcing side plate; 2, 3 heat transfer plate; 5 first inflow pipe; 6 first outflow pipe; 7 second inflow pipe; 8 second outflow pipe; 9 first inlet; 10 first outlet; 11 second inlet; 12 second outlet; 13 first passage; 14 second passage; 15, 16 wavy portion; 17 heat-exchanging passage; 18, 19, 20, 21 hatched portion; 22, 26 bypass passage; 23, 27, 37, 40, 41, 44, 47, 48 wavy portion; 24, 28 sealed portion; 25 main inflow passage; 29 main outflow passage; 30, 31, 32, 33 line; 34 edge; 35, 38, 42, 45 near-center area; 36, 39, 43, 46 long-side-peripheral portion; 50 plate heat exchanger; 51 compressor; 52, 57 heat exchanger; 53, 56, 61 expansion mechanism; 54 receiver; 55 internal heat exchanger; 58 main refrigerant circuit; 59 four-way valve; 60 fan; 62 injection circuit; 63 water circuit; 100 heat pump apparatus

The invention claimed is:

1. A plate heat exchanger comprising a plurality of plates each having, at four corners thereof, respective passage holes each serving as an inlet or an outlet for a first fluid or a second fluid, the plates being stacked such that first passages each defined by adjacent two of the plates and through which the first fluid flows and second passages each defined by adjacent two of the plates and through which the second fluid flows are provided alternately in a stacking direction, wherein the first passage allows the first fluid having flowed therein from an inlet as one of the passage holes that is provided on one side of each of the plates in a long-side direction to be discharged from an outlet as one of the passage holes that is provided on the other side of the plate in the long-side direction, wherein the first passage includes a heat-exchanging passage provided between the inlet and the outlet and in which the second fluid that flows through the second passage adjacent to the first passage and the first fluid exchange heat therebetween, wherein the first passage includes an upstream-side bypass passage extending along an upstream-side adjacent hole, which is another one of the passage holes that is provided on the one side in the long-side direction and is different from the inlet, wherein the upstream-side bypass passage is connected to the heat-exchanging passage from an inlet peripheral portion, which is an area around the inlet to a long-side-peripheral portion, which is an area around a long side of the plate that is nearer to the upstream-side adjacent hole, wherein the upstream-side bypass passage allows some of the first fluid having flowed therein from the inlet to flow from the long-side-peripheral portion into the heat-exchanging passage, wherein the upstream-side bypass passage flows around an arc which directs the flow downward and then upward, wherein the arc is greater than 90°, and wherein the upstream-side bypass passage has a cross-sectional passage area that is reduced toward the long-side-peripheral portion.

2. The plate heat exchanger of claim 1, wherein the first passage includes a downstream-side bypass passage extending along a downstream-side adjacent hole, which is another one of the passage holes that is provided on the other side in the long-side direction and is different from the outlet, wherein the downstream-side bypass passage extends from the long-side-peripheral portion that is nearer to the downstream-side adjacent hole up to an outlet peripheral portion, which is an area around the outlet, wherein the downstream-side bypass passage allows the first fluid flowing on a side of the heat-exchanging passage that is nearer to the downstream-side adjacent hole to flow into the outlet, and wherein the downstream-side bypass passage has a cross-sectional passage area that is reduced toward the outlet.

3. The plate heat exchanger of claim 1, wherein the upstream-side adjacent hole has a circular shape, one of the two plates defining the first passage has a wavy portion that is displaced in the plate stacking direction and provides the upstream-side bypass passage, wherein the wavy portion has a ridge line at a top of a wave that extends along the upstream-side adjacent hole, and wherein the wavy portion is configured such that a straight line passing through an end of the ridge line that is nearer to the long-side-peripheral portion and a center of the upstream-side adjacent hole is at an angle of 90 degrees or larger and 180 degrees or smaller with respect to a short side of the plate.

4. The plate heat exchanger of claim 1, wherein the upstream-side bypass passage has such a shape that, when seen in the plate stacking direction, a wall thereof that is nearer to the upstream-side adjacent hole has an arc shape extending from the inlet peripheral portion up to the long-side-peripheral portion that is nearer to the upstream-side adjacent hole.

5. The plate heat exchanger of claim 1, wherein one of the two plates defining the first passage has a first wavy portion that is displaced in the plate stacking direction and provides the upstream-side bypass passage, wherein the first wavy portion has the ridge line at the top of the wave that extends along the upstream-side adjacent hole, wherein the other of the two plates defining the first passage has, on the side of the upstream-side adjacent hole that is nearer to the heat-exchanging passage, a second wavy portion that is displaced in the plate stacking direction, wherein the second wavy portion has ridge lines at tops of waves that extend radially with respect to the upstream-side adjacent hole, and wherein the second wavy portion is configured such that some of the ridge lines near the long-side-peripheral portion are oriented in a direction closer to the long-side direction than the radial direction with respect to the upstream-side adjacent hole.

6. The plate heat exchanger of claim 1, wherein the two plates defining the first passage each have, in the heat-exchanging passage at the inlet, the wavy portion that is displaced in the plate stacking direction, wherein the wavy portion has ridge lines at tops of waves that extend radially with respect to the inlet, and wherein the wavy portion is configured such that some of the ridge lines near the long-side-peripheral portion are oriented in the direction closer to the long-side direction than the radial direction with respect to the inlet.

7. The plate heat exchanger of claim 1, wherein the cross-sectional passage area of the upstream-side bypass passage gradually reduces from an entrance side of the cross-sectional passage area, wherein the entrance side is at the inlet peripheral portion, toward an exit side of the upstream-side bypass passage, wherein the exit side is nearer to the long-side-peripheral portion.

8. The plate heat exchanger of claim 1, wherein the cross-sectional passage area of the upstream-side bypass passage, which is reduced toward the long-side-peripheral portion, extends around a periphery of the upstream-side adjacent hole and flows the first fluid in the upstream-side bypass passage around the upstream-side adjacent hole and then toward the heat-exchanging passage.

9. A heat pump apparatus comprising:

a refrigerant circuit including a compressor, a first heat exchanger, an expansion mechanism, and a second heat exchanger that are connected with pipes, wherein the first heat exchanger included in the refrigerant circuit is a plate heat exchanger including a plurality of plates each having, at four corners thereof, respective passage holes each serving as an inlet or an outlet for a first fluid or a second fluid, the plates being stacked such that first passages each defined by adjacent two of the plates and through which the first fluid flows and second passages each defined by adjacent two of the plates and through which the second fluid flows are provided alternately in a stacking direction, wherein the first passage allows the first fluid having flowed therein from an inlet as one of the passage holes that is provided on one side of each of the plates in a long-side direction to be discharged from an outlet as one of the passage holes that is provided on the other side of the plate in the long-side direction, wherein the first passage includes a heat-exchanging passage provided between the inlet and the outlet and in which the second fluid that flows through the second passage adjacent to the first passage and the first fluid exchange heat therebetween, wherein the first passage includes an upstream-side bypass passage extending-along an upstream-side adjacent hole, which is another one of the passage holes that is provided on the one side in the long-side direction and is different from the inlet, wherein the upstream-side bypass passage is connected to the heat-exchanging passage from an inlet peripheral portion, which is an area around the inlet to a long-side-peripheral portion, which is an area around a long side of the plate that is nearer to-the upstream-side adjacent hole, wherein the upstream-side bypass passage allows some of the first fluid having flowed therein from the inlet to flow from the long-side-peripheral portion into the heat-exchanging passage, wherein the upstream-side bypass passage flows around an arc which directs the flow downward and then upward, wherein the arc is greater than 90°, and wherein the upstream-side bypass passage has a cross-sectional passage area that is reduced toward the long-side-peripheral portion.

10. The plate heat exchanger of claim 1, wherein the upstream-side bypass passage has a substantially curved shape.

11. The plate heat exchanger of claim 1, wherein the upstream-side bypass passage is provided on a side of the upstream-side adjacent hole that is nearer to the heat-exchanging passage.

12. The plate heat exchanger of claim 1, wherein the cross-sectional passage area of the upstream-side bypass passage gradually reduces from the inlet toward the long-side-peripheral portion.

13. The heat pump apparatus of claim 9, wherein the cross-sectional passage area of the upstream-side bypass passage gradually reduces from the inlet toward the long-side-peripheral portion.

14. The heat pump apparatus of claim 9, wherein the cross-sectional passage area of the upstream-side bypass passage gradually reduces from an entrance side of the cross-sectional passage area, wherein the entrance side is at the inlet peripheral portion, toward an exit side of the upstream-side bypass passage, wherein the exit side is nearer to the long-side-peripheral portion.

15. The heat pump apparatus of claim 9, wherein the cross-sectional passage area of the upstream-side bypass passage, which is reduced toward the long-side-peripheral portion, extends around a periphery of the upstream-side adjacent hole and flows the first fluid in the upstream-side bypass passage around the upstream-side adjacent hole and then toward the heat-exchanging passage.

* * * * *